US007730579B2

(12) United States Patent
Coe

(10) Patent No.: US 7,730,579 B2
(45) Date of Patent: Jun. 8, 2010

(54) DOOR CLOSURE APPARATUS

(76) Inventor: Thomas Edward Coe, 26 Lynn Grove Rd., Northwood, NH (US) 03261

( * ) Notice: Subject to any disclaimer, the term of this patent is extended or adjusted under 35 U.S.C. 154(b) by 148 days.

(21) Appl. No.: 11/523,239

(22) Filed: Sep. 19, 2006

(65) Prior Publication Data

US 2008/0120923 A1 May 29, 2008

(51) Int. Cl.
*E05F 3/02* (2006.01)

(52) U.S. Cl. ..... 16/66; 16/49; 267/120

(58) Field of Classification Search ..... 16/49, 16/72, 76, 80, 63–66; 267/120
See application file for complete search history.

(56) References Cited

U.S. PATENT DOCUMENTS

| | | | | | |
|---|---|---|---|---|---|
| 3,090,988 | A | | 5/1963 | Truhon | |
| 4,596,383 | A | * | 6/1986 | Howard | 267/64.12 |
| 4,744,548 | A | * | 5/1988 | Hathaway | 267/64.12 |
| 4,790,580 | A | * | 12/1988 | Casilio | 292/262 |
| 4,813,100 | A | * | 3/1989 | King | 16/49 |
| 4,894,883 | A | | 1/1990 | Fleischhauer | |
| 5,048,150 | A | | 9/1991 | Guerin | |
| 5,157,806 | A | * | 10/1992 | Wartian | 16/66 |
| 5,197,635 | A | * | 3/1993 | Chang | 222/137 |
| 5,358,225 | A | * | 10/1994 | Volpel et al. | 267/64.12 |
| 5,529,225 | A | * | 6/1996 | Chang | 222/391 |
| 5,575,513 | A | * | 11/1996 | Tuttle | 292/339 |
| 5,630,248 | A | | 5/1997 | Luca | |
| 5,855,039 | A | | 1/1999 | Crawford | |
| 6,202,253 | B1 | | 3/2001 | Green | |
| 6,273,405 | B2 | * | 8/2001 | Okamoto | 267/64.12 |
| 6,601,834 | B2 | * | 8/2003 | Perry | 267/64.12 |
| 2005/0155179 | A1 | * | 7/2005 | Duffy | 16/66 |

* cited by examiner

*Primary Examiner*—Victor Batson
*Assistant Examiner*—Emily M Morgan
(74) *Attorney, Agent, or Firm*—Daniels Patent Law PLLC; Scott A. Daniels

(57) ABSTRACT

A door holder and a door closer and, in particular, and improvements in door holders and closers for use in screen doors, storm doors or any type of door which has the need for a device for maintaining the door in a particular orientation and/or for self-closing of the door.

7 Claims, 12 Drawing Sheets

DOOR CLOSURE APPARATUS

FIELD OF THE INVENTION

The present invention relates to door holders and door closers and, in particular, to improvements in door holders and closers for use in screen doors, storm doors or any type of door which has the need for a device for maintaining the door in a particular orientation and/or for self-closing of the door.

BACKGROUND OF THE INVENTION

Screen door and storm door closers are known in the art. Door holders, are utilized for holding side pivoted, i.e., hinged, doors open against the self-closing action of such a door closer. This self-closing action of the door closer is caused by a coil spring which is either elongated or compressed, depending on the type of mechanism, when the door is opened.

Such self-closing mechanisms usually consist of a cylinder connected at one end to the door frame, a spring loaded piston rectilinearly displaceable in the cylinder, and a piston rod fixed to the piston and extending from the second end of the cylinder. The free end of the piston rod is rotatably or pivotally connected to the door itself.

These types of self-closing mechanisms function as air enters the cylinder freely as the door is opened. The air escapes at a controlled rate through an orifice as the door is closed by the force of the spring, thus slowing the rate at which the door is closed by an air cushioning or damping action, much like a gas spring.

The more advanced of the known door closers have a mechanism for holding the door open after it has been manually swung open to a predefined position. This allows for a person carrying groceries or other objects to conveniently walk through a door without having to continuously overcome the force of the closing spring. One of the only complaints in the use of such door closers is the ease with which a person can set the door closer to stay open or conversely, the ease with which a door being held open can be released.

OBJECT AND SUMMARY OF THE INVENTION

There is a need for a more convenient door closer and holder, which requires little effort from a person to enable the door to remain open or to close the door and which can even be retrofit to existing door closers without increasing the complexity and cost of manufacturing. The present invention is directed at further solutions to address this need, including the invention of a door-waiter for use as a door holder.

In accordance with one aspect of the present invention, the door-waiter is used in conjunction with a spring loaded cylinder and piston rod assembly which provides the force to automatically close the door.

In accordance with another aspect of the present invention, the door-waiter has a body including a stepped cylinder holding section which will automatically hold the spring loaded cylinder and the door in a desired open position.

In accordance with yet another aspect of the present invention, a door closer has a kick-out assembly, which facilitates an ergonomic disengagement and respective self-closing of the door-waiter when the door is being held open.

In accordance with further aspects of the present invention, the door holder has an automatic release response to prevent damage to the door or the door holder assembly.

The present invention also relates to a door closer (10) comprising a frame bracket (7) and a door bracket (4); a spring-loaded cylinder (12) and piston rod assembly (16) extendable between an open and a closed positions; a door-waiter (34) pivotably supported adjacent a first end (18) of the piston rod (16) connected to one of the frame bracket and the door bracket; and wherein the door-waiter (34) is capable of retaining the spring-loaded cylinder (12) and piston rod assembly (16) in the open position by rotating about its pivotal support adjacent the first end of the piston rod (16) and engaging a holding portion of the door-waiter (34) with an end surface of the cylinder (12).

The present invention also relates to a door closer (10) comprising a frame bracket (7) and a door bracket 4; a spring-loaded cylinder (12) and piston rod assembly (16) extending between the frame bracket and the door bracket; a cylinder housing (34) at least partially encompassing the cylinder and piston rod assembly and being pivotably supported adjacent a first end (18) of the piston rod (16).

DETAILED DESCRIPTION OF THE INVENTION

Figure 1:
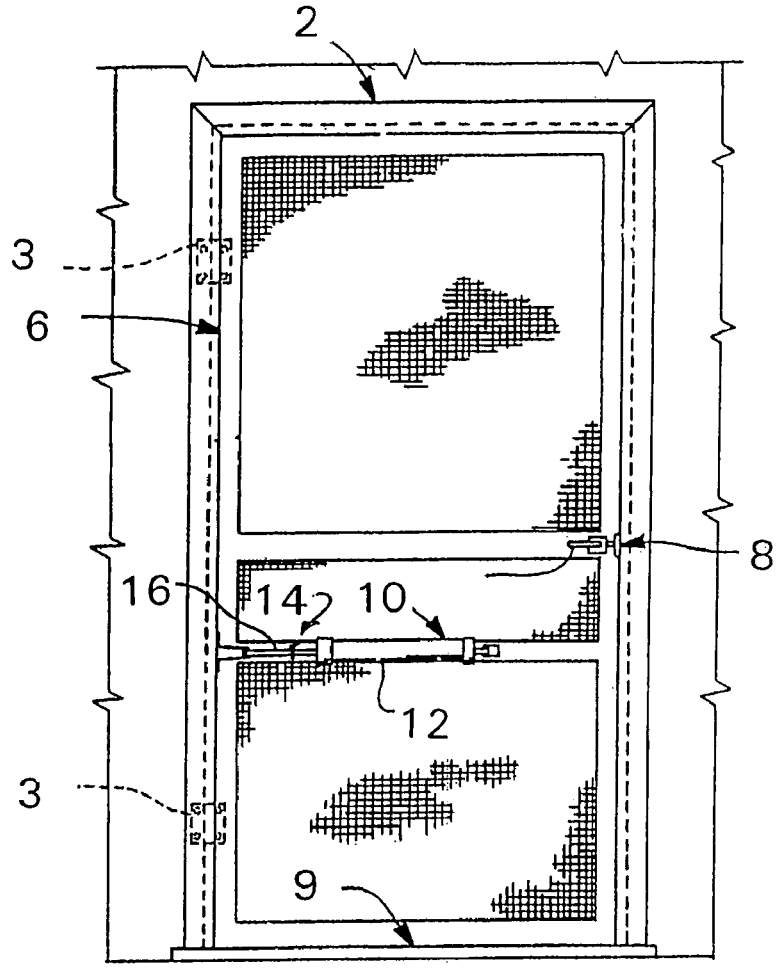
Fig. 1 PRIOR ART
FIG. 1 is a conventional screen door with a conventional door closer attached thereto in the closed position.
Figure 2:
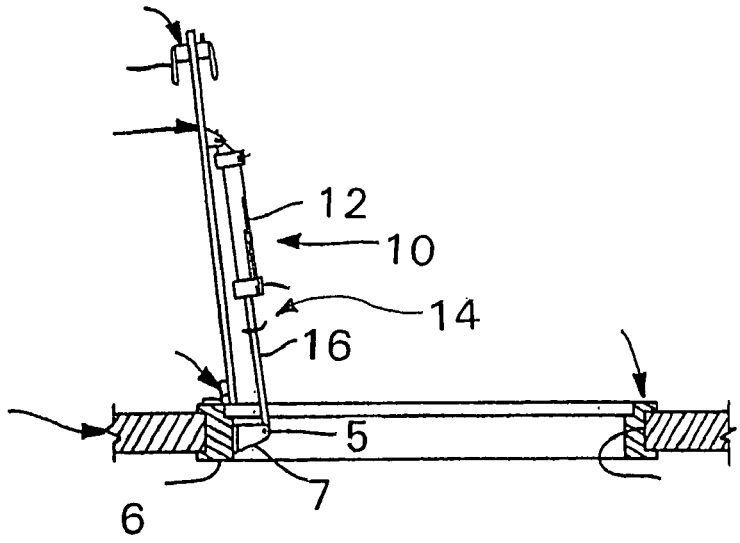
Fig. 2 PRIOR ART
FIG. 2 is a top plan view of the conventional screen door with the door closer attached thereto in the open position.

As is known in the art, and referring to FIGS. 1 and 2, a door 2 is shown equipped with a spring operated and pneumatically damped door closer 10 as known in the art. The door 2 is fixed by hinges 3 to one vertical side of a door frame 6. The door frame 6 is set in an opening through a wall above a door sill 9. The door 2 can accordingly be swung between the closed position shown in FIG. 1 and the open position, illustrated in FIG. 2, by the handle of a latch 8, which is employed to secure the door 2 in its closed, FIG. 1 position.

In general, the door closer 10 is affixed to the door frame 6 at one end by a door frame bracket 7 and at the opposing end to the door 2, by a door bracket 4. During use, the door 2 is automatically returned from an open position, such as that shown in FIG. 2, to the closed position of FIG. 1 at a controlled rate via a coil spring 26 encased within the cylinder 12, and a corresponding pneumatically controlled air damping action. The damping action controls the rate of return movement of the door 2 by regulating the escape of air from the cylinder 12 relative to the coil spring 26, which continuously urges the piston rod 16 toward a retracted relationship in the cylinder 12, as well known in the art. Alternatively, the door 2 may be maintained in the open position, as shown in FIG. 2, by a friction tab 14 on the cylinder piston being slid along the piston rod 16 to a point where the friction tab 14 contacts and frictionally interferes with the movement of the cylinder 12 along and relative to the piston.

Figure 3:
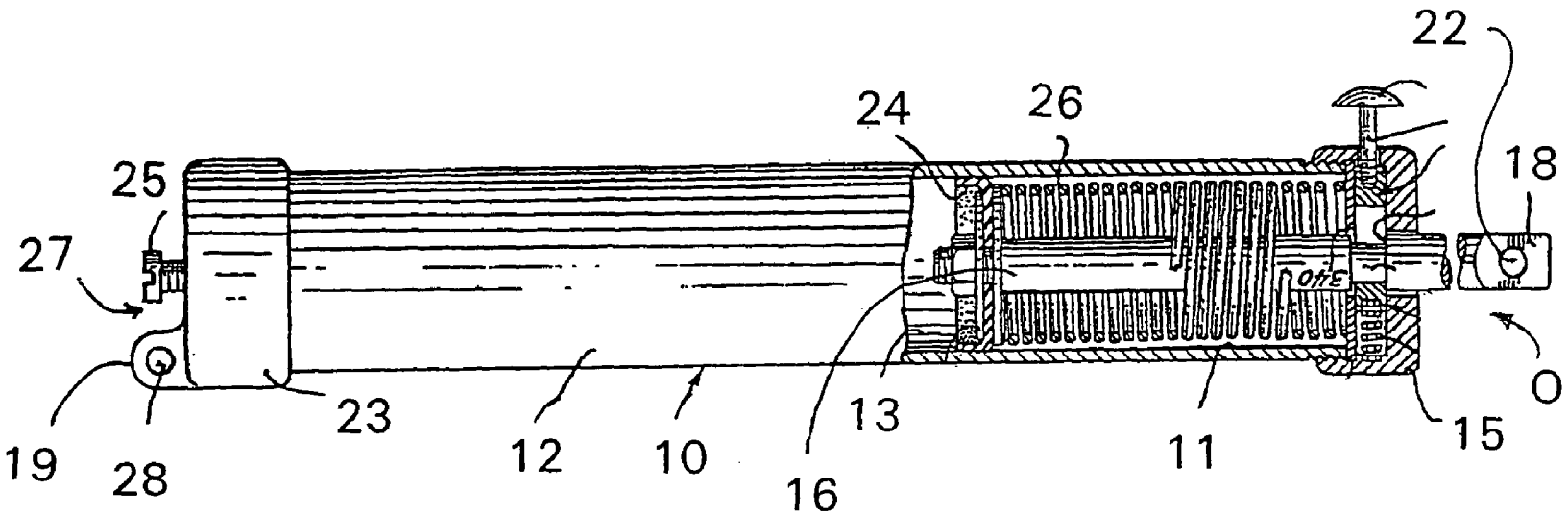
Fig. 3 PRIOR ART
FIG. 3 is a conventional door closer apparatus.

As shown in FIG. 3, the damping cylinder 12 is of common construction and has an opening O on a first end 18 to allow the piston rod 16 to enter into the cylinder 12. The inner surface of the cylinder 12 is substantially smooth with no protrusions or indentations to permit the piston to slide therein and the interior compartment of the cylinder 12 is essentially divided into a spring compartment 11 and an air compartment 13 on opposing sides of the piston 24. For example, in a closed position the coil spring 26 inside the spring compartment 11 of the cylinder 12 is expanded to push the piston 24 into the air component 13 of the cylinder 12. The air compartment 13 is maximized thus shortening the length of the door closer 10 and closing the door 2. When a force is applied to open the door 2, the piston 24 compresses the spring and ambient air is permitted to flow through an orifice 27 past an adjustable air stop 25 and into the air compartment 13, and the overall length of the door closer 10 increases until the point at which the force is removed. Subsequently, the spring bias causes the piston 24 to extend and close the door 2. As the general structure and operation of such a gas/spring cylinder is well known in the art, no further discussion is believed necessary.

Figure 4:
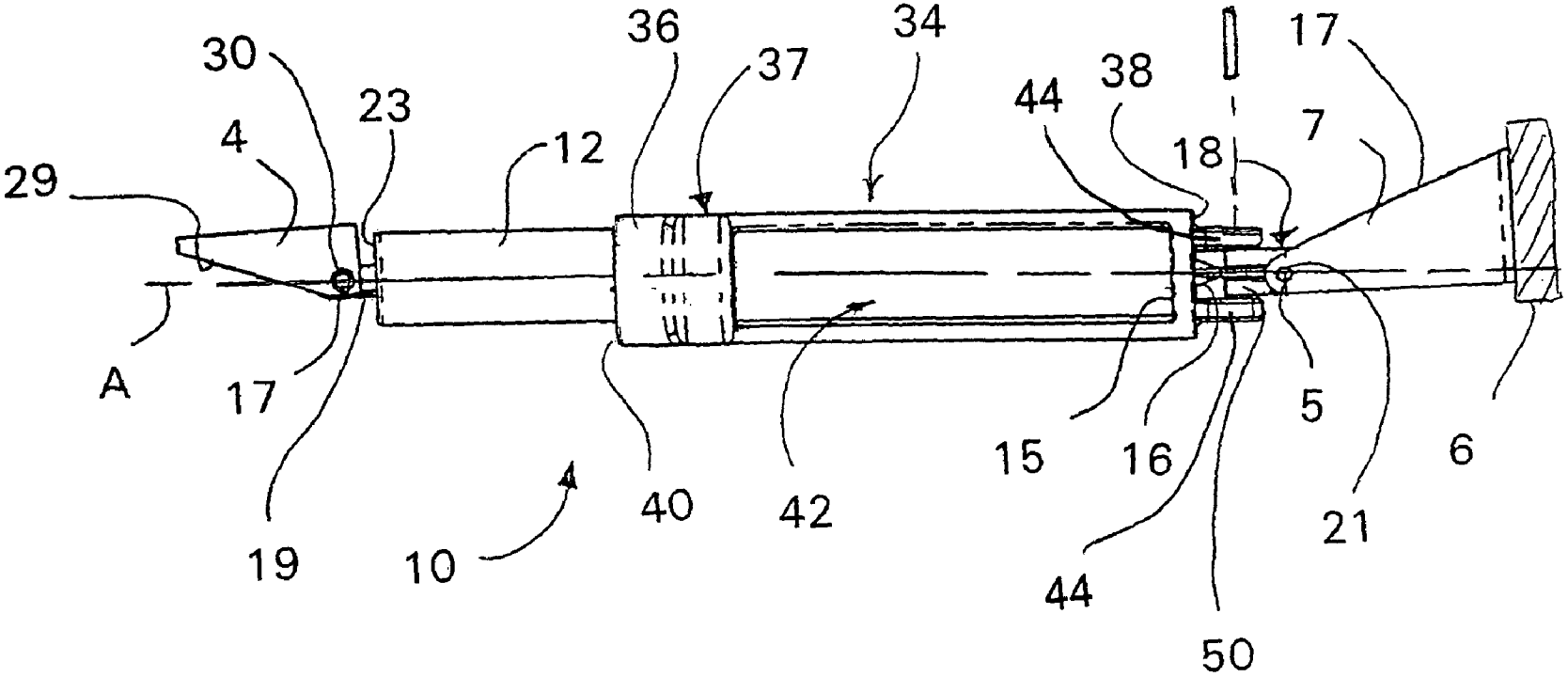
FIG. 4 is a top elevational view of one embodiment of the present invention showing the door-waiter in an inoperative, door closed position.
Figure 5:
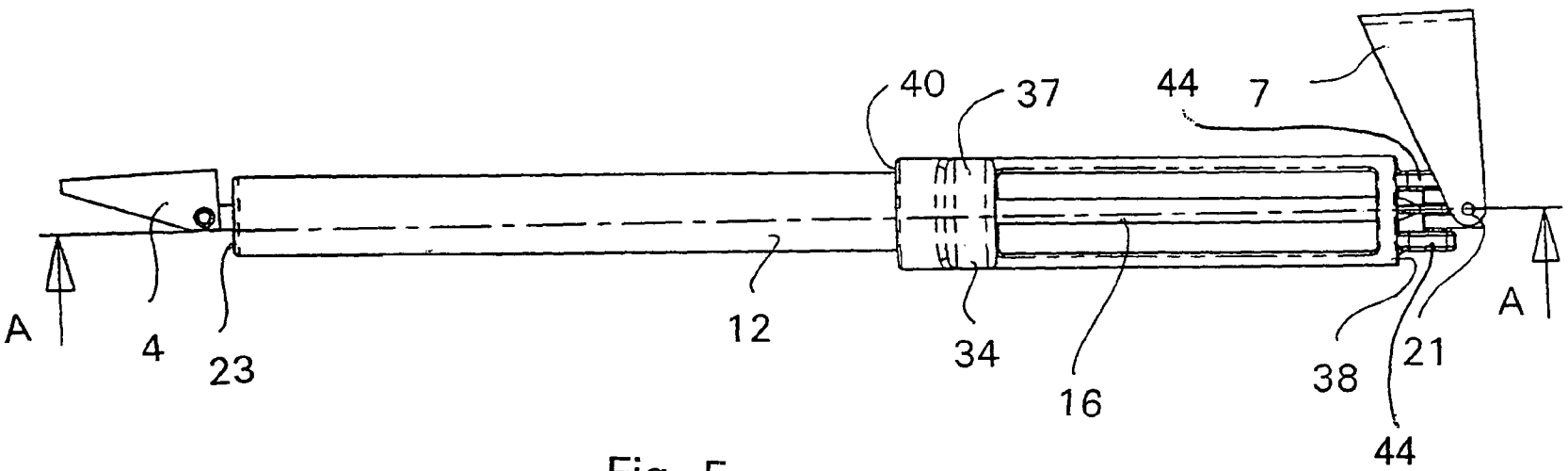
FIG. 5 is a top elevational view of one embodiment of the present invention showing the door-waiter in an operative, door open position.

FIG. 4 shows a first embodiment of the present invention, a door closer 10 of the present invention is shown defined substantially about a central axis A extending the length of the door closer 10 between a door frame pivot 5 on door frame bracket 7 to opposing protruding arms 17 located on a door bracket 4. The door frame bracket 7 is generally attached to the inner part of a door frame 6, substantially aligned with the vertical positioning of the door hinges 3. The door bracket 4 is generally attached to the inside surface of a door 2 (i.e., the side of a door which faces the inside of the home, garage, shed, or the like). The door bracket 4 is mounted on the door 2 at a vertical height relative to the floor or door sill 9, substantially the same as the door frame bracket 7, such that the central axis A of the door closer 10 remains essentially horizontal relative to the floor. Each of the door bracket 4 and door frame bracket 7 are held in place by screws, nails, or any other mounting means known in the art, through respective mounting plates as also known in the art.

The door frame bracket 7 has a pair of opposing parallel, identical protruding arms 17 extending perpendicular to the mounting plate and horizontally away from the door frame 6. Each opposing arm 17 has a pin hole 21 which is aligned with a corresponding pin hole 22 through the free end 18 of the piston rod 16 when the free end of the piston rod 18 is placed in between the two opposing arms 17 of the door frame bracket 7. The free end 18 of the piston rod 16 is shaped to fit horizontally, rotatably but vertically secured between the two opposing arms 17 of the door frame bracket 7 when the free end 18 of the piston rod 16 is inserted in between the two opposing arms 17. A pin is vertically inserted through the corresponding pin holes 21, 22 to secure the piston rod 16 to the door frame bracket 7. The pin is generally maintained in positioning securing these components by gravity, where a larger head of the pin keeps the pin from falling though the pin holes 21, 22 in the door frame bracket 7 and piston rod 16.

The opposing end of the piston rod 16 is fixed to the slidable piston 24 which is slidably secured within the cylinder 12 as described above. The second end 23 of the cylinder 12, opposite from the first end 15 through which the piston rod 16 passes, has a small tab 19 extending away from the cylinder 12 generally along the central axis A of the door closer 10, although the tab 19 could be offset as well. This tab 19 is provided with a door bracket pin hole 28 through which the second end 23 of the damping cylinder 12 is rotatably affixed to the door bracket 4 by a door bracket pin substantially similar in nature to the attachment described above relative to the door frame bracket 7.

The door bracket 4 also has a pair of opposing identical horizontally protruding arms 29 extending perpendicular to and away from the door 2. These arms 29 have aligning holes 30, similar to the pin holes 21 of the door frame bracket 7, which provide horizontal pivoting support when the cylinder tab 19 is inserted between the arms 29 and a door bracket pin is passed through the corresponding aligning holes 30 and the door bracket pin hole 28 in the tab 19 on the damping cylinder 12.

The embodiment of the present invention, shown in FIGS. 4-7, provides the conventional door closer with a door-waiter 34 as a means for retaining the door 2 in the open position. The door-waiter 34 is a substantially hollow, cylindrical tube 36 defined by a cylindrical sidewall 37 positioned around the cylinder 12 and the piston rod 16. The door-waiter 34 is connected at a first end 38 in some manner to the door frame bracket 7, and a second end 40 of the door-waiter 34 is essentially free and includes a cylinder engaging portion. Slots or windows 42 can be formed though the sidewall 37 of the door-waiter 34 to provide access to the damping cylinder 12 and to facilitate the relative longitudinal axial movement between the door-waiter 34 and the damping cylinder 12.

Figure 6:
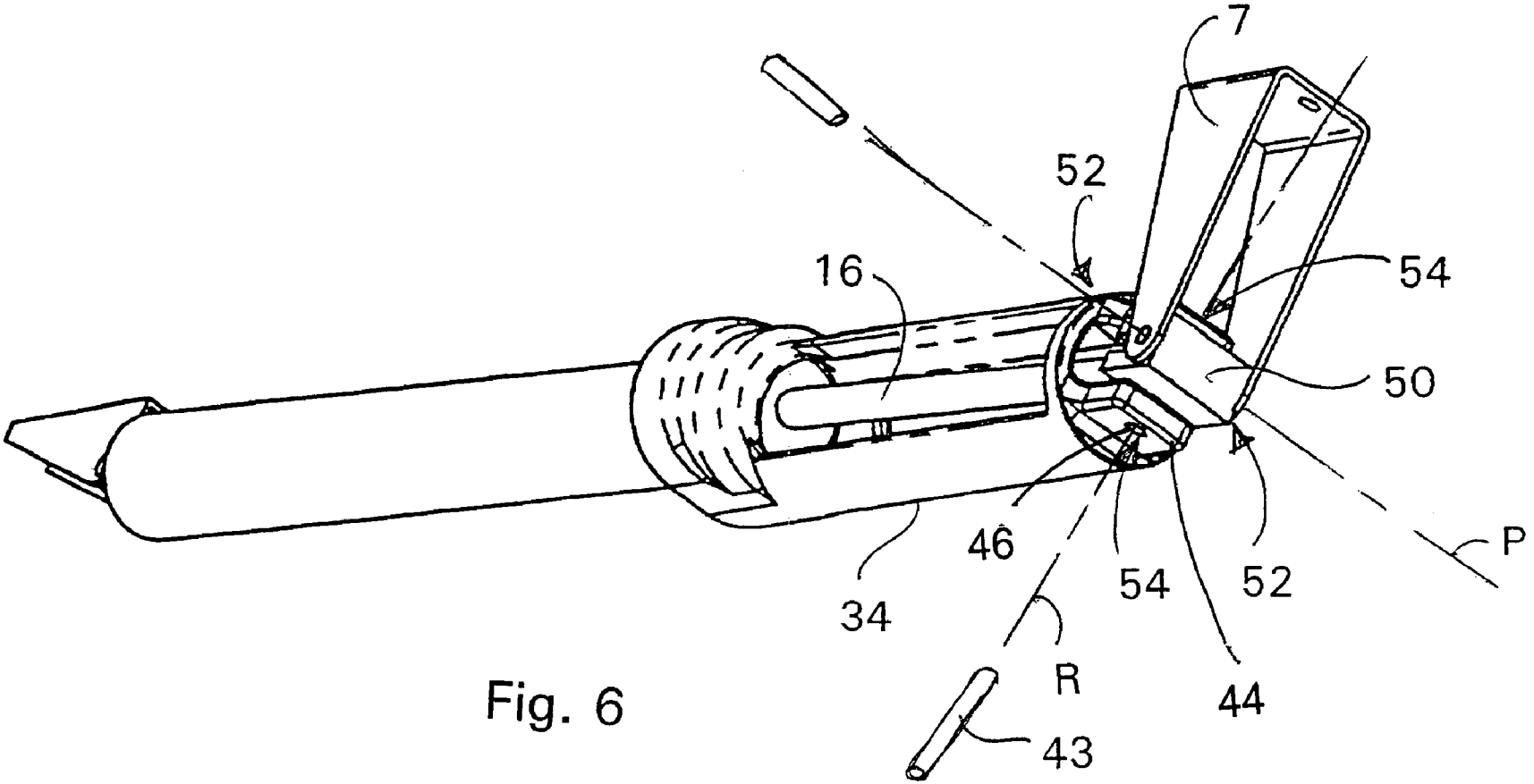
FIG. 6 is a perspective view of the first embodiment of the present invention including the door-waiter.

In the present embodiment as seen in FIGS. 4-7, the first end 38 of the door-waiter 34 is connected to a pin block 50 which connects both the door-waiter 34 and the free end of the piston rod 16 to the door frame bracket 7. The pin block 50 is an intermediate feature which has both a first passage 52 and a second passage 54 defined about axes P and R respectively as seen in FIG. 6 which are generally perpendicular to one another so as to permit rotation of the pin block about a vertical axis P with the pin holes 21 in the door bracket arms 17, and horizontal rotation of the door-waiter 34 and piston rod 16 about axis R. This horizontal rotation of the door-waiter 34 and piston rod 16 is necessary for the door holding function of the door-waiter 34, explained in detail below.

The first end 38 of the door-waiter 34 has two support flanges 44 having flange holes 46 defining the door-waiter rotation axis R there between. The flanges 44 are aligned with one of the passage of the pin block 50, as well as the pin hole 22 in the free end 18 of the piston rod 16 and a door-waiter pin 43 is then passed through the flanges 44 on the first end 38 of the door-waiter 34, the pin block 50 and also the pin hole 22 in the free end 18 of the piston rod 16 along the axis R to define rotation for the door-waiter 34 about the substantially horizontal door-waiter axis R.

The first passage 52 in the pin block 50 is connected to the door frame bracket 7 along the axis P defined by the pin holes 21 in the arms 17 of the door frame bracket 7. Thus, the separate door-waiter rotation axis R and the vertical axis P of the door bracket 7 connection are separate axis of rotation which allow substantially 360 degree freedom of rotation to the door closer 10 and the door-waiter 34 within a desired range.

Figure 7:
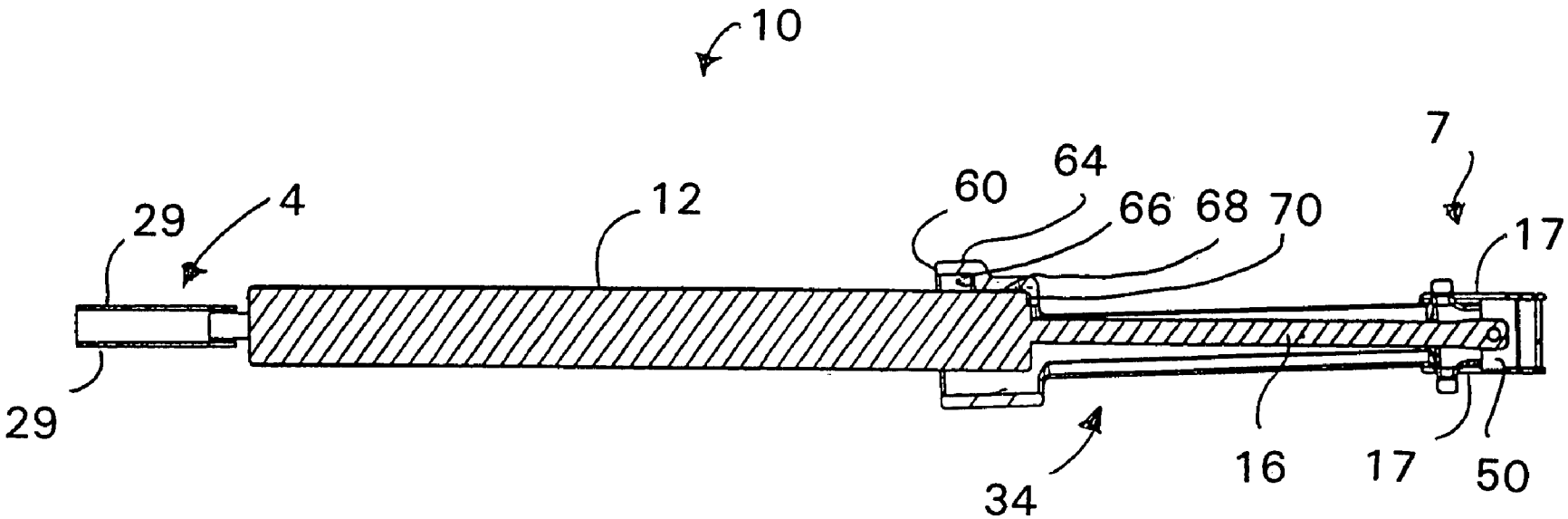
FIG. 7 is a cross-sectional view of the first embodiment of the present invention in the open or extended position.

A cross-section of the door-waiter 34, shown in FIG. 7, shows the door-waiter 34 as it is engaged with the first end 15 of the damping cylinder 12 when it is desired that the door 2 be maintained in an open position. The second free end 40 of the door-waiter 34 is provided with a partially stepped profile where the first end opening is defined by a rim 60 of a first sidewall portion 64 which has a desired axial length. A first step 66 is defined by a radial ledge having a desired step length extending radially inward towards the damping cylinder 12. From the first step 66, a second axial sidewall 68 extends axially to a second step 70 defined by another radial ledge extending inwardly towards the damping cylinder 12. From the second step 70, the inner sidewalls of the door-waiter 34 extend axially to the first end 38 of the door-waiter 34. It is to be appreciated that there could be more than a first and second step in the stepped portion profile of the door-waiter 34.

As described above, the second free end 40 of the door-waiter 34 is a two tiered step-profile formed generally in a top-most, circumferential portion of the door-waiter 34. In other words, in this embodiment the stepped profile only extends partially around the circumference of the door-waiter 34. As seen in FIG. 7, the stepped profile is not formed on a bottom portion of the door-waiter 34. It is conceivable that the stepped profile could extend completely circumferentially around the door-waiter 34 or be located on a portion besides the top-most portion as well.

The stepped profile is formed generally on the top portion of the door-waiter 34 so that gravity will facilitate the functioning of the device to hold the door 2 open as follows. When the door 2 is in the closed position, the piston 24 and most of the piston rod 16 are collapsed within the damping cylinder 12 as seen in FIG. 4. In this position, the first end 15 of the cylinder 12 rests at the first closed end 38 of the door-waiter 34.

As the door 2 is opened, the damping cylinder 12, which is of course, attached at the second end 23 to the door bracket 7, is extended away from the first end 38 of the door-waiter 34 and exposes the piston rod 16. When the door 2 is open in FIGS. 5-7, the piston rod 16 is nearly extended fully and the first end 15 of the cylinder 12 approaches the stepped portion of the door-waiter 34. If the door 2 is extended to a slightly greater extent, the first end 15 of the cylinder 12 passes into the second step 70 of the door-waiter 34. The weight of the door-waiter 34 itself causes the door-waiter 34 to rotate slightly about the axis R defined by the flange holes 44 and the respective passage in the pin block 50, and the second step 70 thus falls down onto the cylinder 12 as seen in FIG. 7. When the door-waiter 34 is in this position, it is said to be in a "locked" position.

While in the locked position, the second radial step 70 engages a portion of the end surface of the cylinder 12 to prevent the door 2 from closing. The end surface of the cylinder 12 remains engaged with the second step 70 by the force of the spring 26 in the cylinder 12 which maintains a tensile force between the damping cylinder 12 and the piston rod 16, thus resulting in a net compressive force between the cylinder 12 and the door-waiter 34.

If the door 2 is opened slightly farther, the first end 15 of the damping cylinder 12 is moved axially farther along the second sidewall portion 68 until reaching the first radial step 66 which permits the door-waiter 34 to fall even slightly lower relative to the cylinder 12, thus allowing the radially aligned first step 66 to engage the end wall of the first end 15 of the cylinder 12 and thus maintain the door 2 locked in an even more open position.

In order to "unlock" the door closer 10, and allow the door 2 to close, a user must simply apply an upward force on the lower-most portion of the door-waiter 34, i.e., opposite to the stepped profile in the top-most portion of the door-waiter 34. Such an upward force on the door-waiter 34 will cause the door-waiter 34 to rotate upwards about the door-waiter rotation axis R and realign the damping cylinder 12 with the interior of the door-waiter 34 and permit the spring 26 and air chamber 13 to allow the door closer 10 to return to its closed position. The force required to realign the cylinder 12 with the door-waiter 34 is equal to the friction force created by the contact of the end surface of the cylinder 12 with the stepped portion of the door-waiter 34 while considering the compressive force provided by the spring 26. Such a restoring force can be lessened by slightly opening the door 2 to lessen the friction force while realigning the inner walls of the door-waiter 34 with the damping cylinder 12.

In another embodiment of the present invention, shown in FIGS. 8-13, the door-waiter 34 is further provided with a kick-out assembly 80 for facilitating the unlocking of the door closer 10 and permitting the door 2 to close. The construction of the door-waiter 34 in this embodiment is substantially the same as the previous embodiment notwithstanding the additional kick-out assembly 80. Viewing FIG. 9, the kick-out assembly 80 can be seen as being incorporated into the structure of the door-waiter 34 and door closer 10 of the previous embodiment to provide two important functions. First, direct actuation of the kick-out assembly 80 unlocks the door closer 10 and permits the damping cylinder 12 and piston rod 16 to compress and close the door 2; second, if the door 2 is pulled shut without actuating the kick-out assembly 80, the kick-out assembly 80 will ensure that the door closer 10 unlocks and is permitted to close. A further discussion of the structure and function of this embodiment is provided below.

Returning to FIG. 8, the kick-out assembly 80 comprises three main parts: a release lever 82, the push rod 84 and the pivot body 86. The release lever 82 extends from a intermediate pivot point 88 with the pivot body 86 within the door-waiter 34 through an opening in the sidewall 37 of the door-waiter 34 to a point outside the door-waiter 34 where a user may easily access and operate the release lever 82. The purpose of the release lever 82 and, in essence the entire kick-out assembly 80, is to provide a user an easy means of disengaging the door-waiter 34 from the cylinder 12 when the door 2 is being held open. The release lever 82, extends from the opening in the door-waiter 34 to a position providing adequate leverage for unlocking the door closer 10 when actuated by a user.

The release lever 82 is connected at the intermediate pivot point 88 with the pivot body 86 and the door-waiter 34. The release lever 82 is thus permitted to rotate about this intermediate pivot point 88 relative to the pivot body 66, the door-waiter 34 and the door closer 10 and unlock the door closer 10 as explained below. A push rod pivot 90 is spaced from the intermediate pivot point 88 and arranged on a second end of the release lever 82 opposite from the contact end of the release lever 82. When the release lever 82 is actuated by a user, the release lever 82 rotates about the intermediate pivot point 88 and pushes the push rod pivot 90, and hence the push rod 84 axially in the direction of the free end 40 of the door-waiter 34, i.e., towards the door bracket 4.

Figure 10:
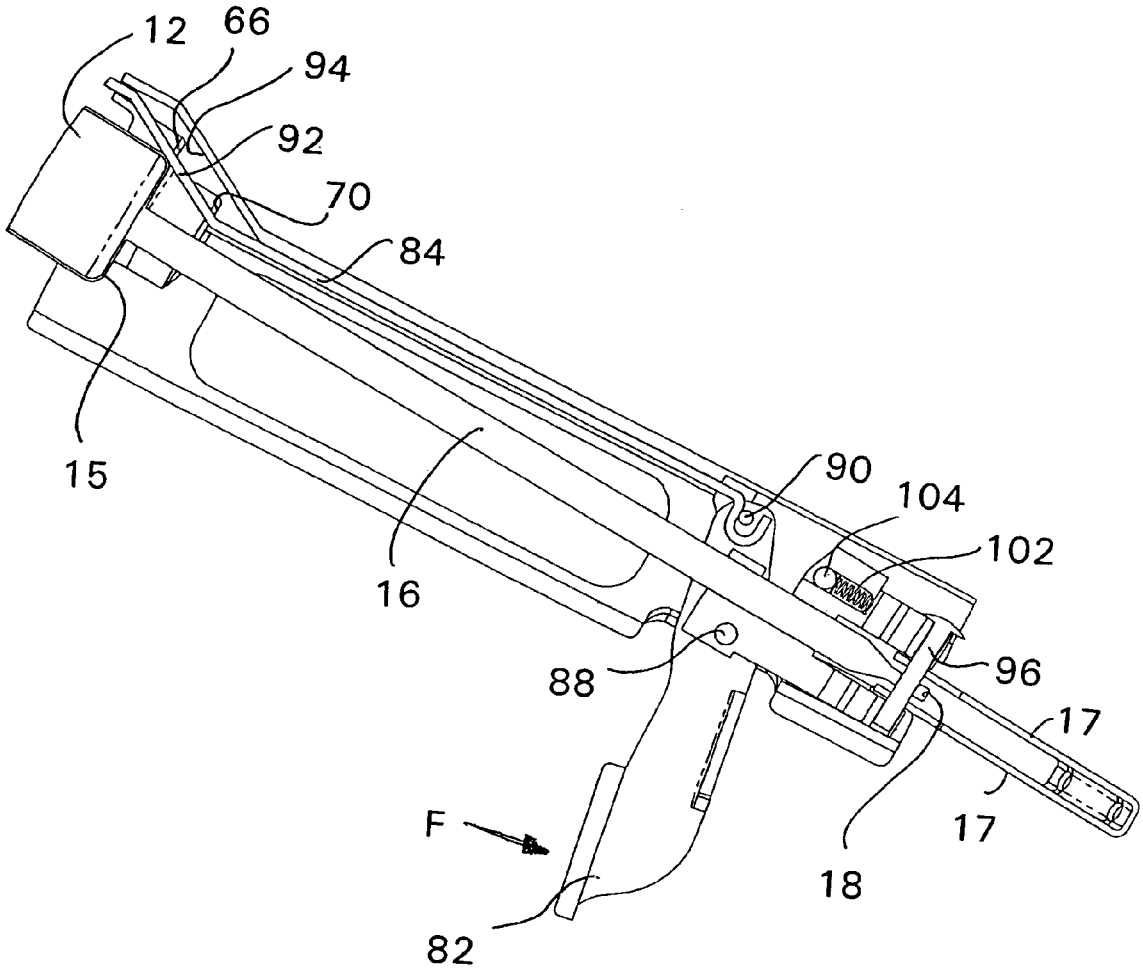
FIG. 10 is a cross-sectional view of the kick-out assembly actuated to close the door.

The push rod 84 is a rigid, flat, rod which substantially follows the inner sidewall profile of the door-waiter 34. The push rod 84 has a pivot end attached to the push rod pivot 90 and a substantially straight portion 91 extending therefrom to an angled portion 92 for engaging the first end 15 of the damping cylinder 12. As seen in FIG. 10, when the release lever 82 is actuated, the push rod pivot 90 forces the push rod 84 axially in the direction of the first end 15 of the damping cylinder 12 so that the axially displaced angled portion 92 of the push rod 84 forces the damping cylinder 12 out of contact with the first 66 or second step 70 formed in the door-waiter 34. The damping cylinder 12 is thus disengaged from the second free end 40 of the door-waiter 34 and is hence permitted to retract into the door-waiter 34 and close the door 2.

In order to accommodate the angled portion 92 of the push rod 84 the stepped profile of the door-waiter 34 is provided with a channel 94 formed in or adjacent the stepped portion of the door-waiter 34 which accepts and maintains the angled portion 92 of the push rod 84 out of contact with the damping cylinder 12 when the door 2 is in the locked position, but permits axial displacement of the angled portion 92 to force the damping cylinder 12 out of engagement with the steps 66, 70 in the second free end 40 of the door-waiter 34. When the user wishes to close the door 2, the user need only provide a slight force against the handle of the release lever 82 by arrow F as indicated in FIG. 10. As the release lever 82 rotates about the intermediate pivot 88, the push rod 84 is moved axially in the direction towards the damping cylinder 12 and causes the angled portion 92 of the push rod 84 to contact the first end 15 of the damping cylinder 12 and push the damping cylinder 12 out of contact with the first step 66 as shown in the Figures. The angled portion 92 of the push rod 83 directs the damping cylinder 12, biased by its inherent compression forces, into the door-waiter 34 closing the door 2.

Figure 8:
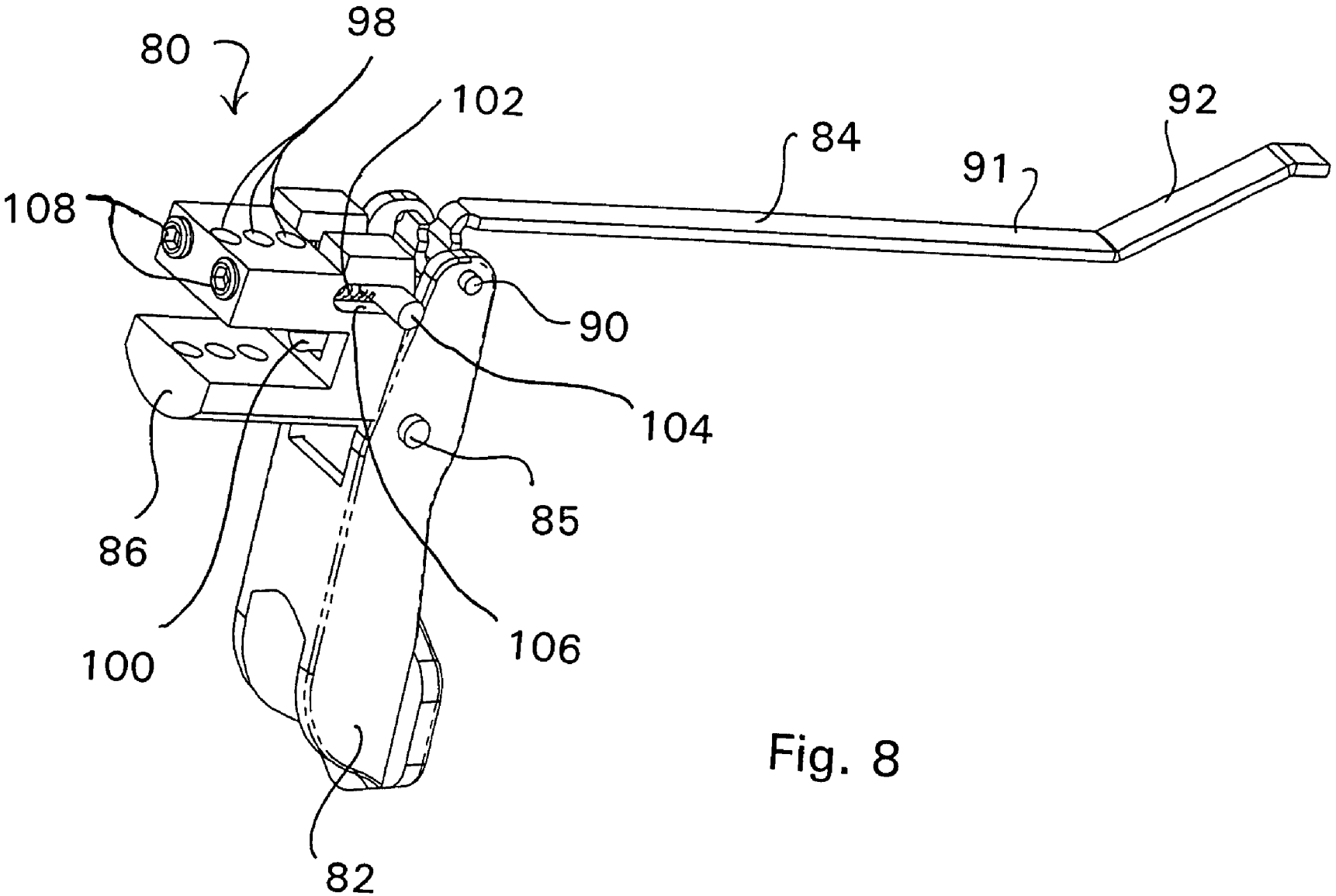
FIG. 8 is a perspective view of the kick-out assembly.
Figure 9:
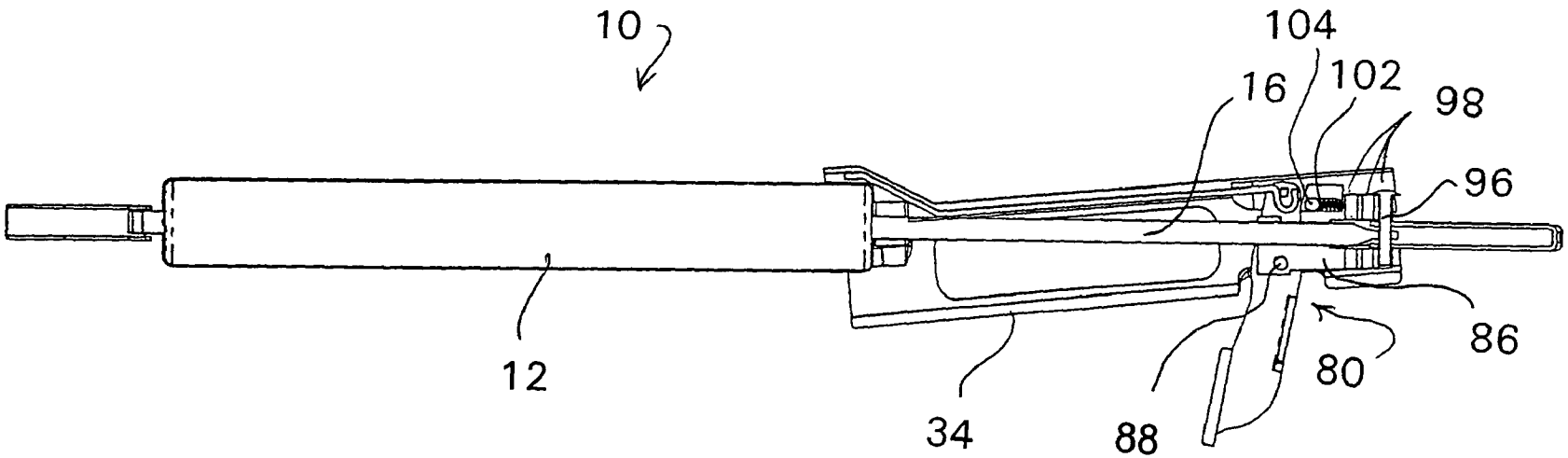
FIG. 9 is a side elevational view of the present invention with the kick-out assembly.
Figure 11:
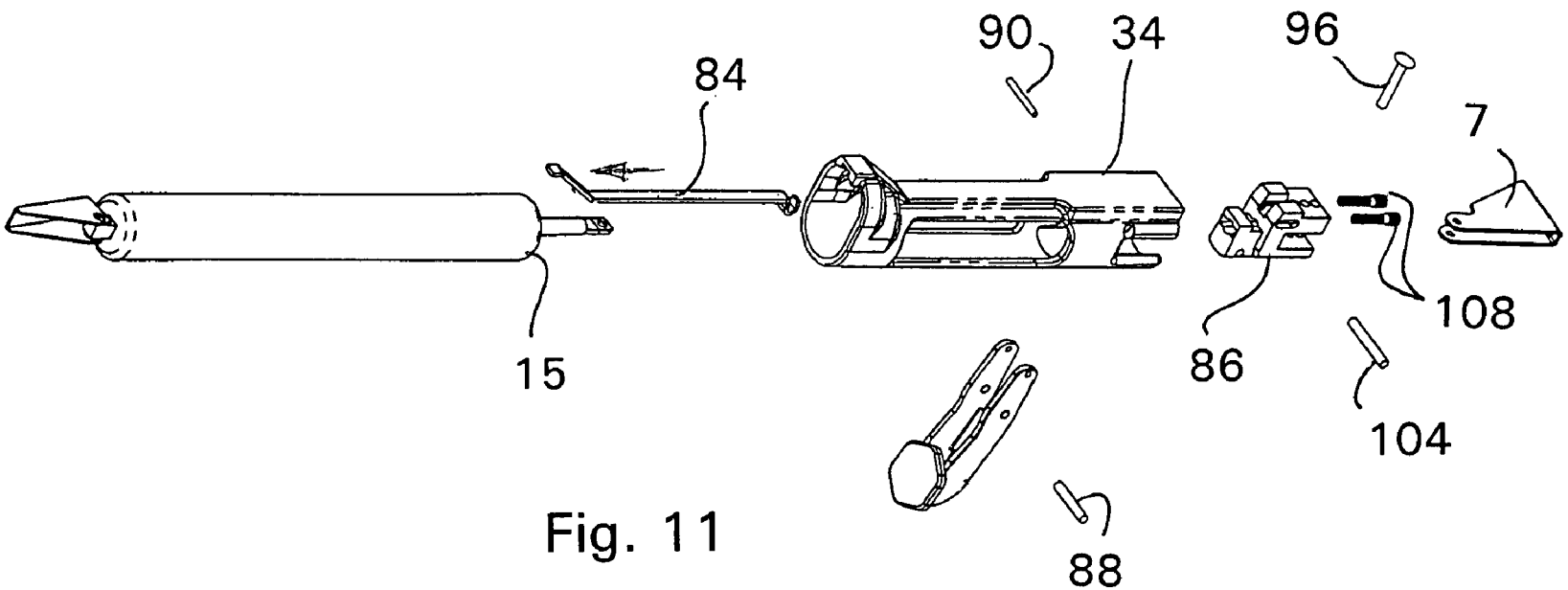
FIG. 11 is a perspective exploded view of the second embodiment of the present invention with the kick-out assembly.

The pivot body 86 which supports the release lever 82 is shown in FIG. 11 achieves two main functions. First, the pivot body 86 provides a substantially static base about which the release lever 82 can rotate about the intermediate pivot 88; second, the pivot body 86 provides an automatic release response if an excessive amount of force is applied when closing the door 2, for example, without actuating the release lever 82. The pivot body 86 is connected to the frame bracket 7 by inserting a connecting pin 96 through one of three possible connecting holes 98 formed in the pivot body 86 and through the holes 98 in the arms 17 of the door frame bracket 7 as seen in FIG. 8. A piston rod passageway 100 is also provided perpendicular to and communicating with the connecting holes 98 so that the piston rod 16 can be inserted therethrough and the free end 18 of the piston rod 16, and the pin hole 22 therein is aligned with the connecting hole 98 and the connecting pin 96 to secure the piston rod 16 to the door frame bracket 7.

The pivot body 86 also includes a pair of tension springs 102 set in a pin slot 106 formed in the pivot body 86. The pin slot 106 is a substantially horizontal slot through the pivot body 86 which accepts a securing pin 104 for securing the pivot body 86 to the sidewalls 37 of the body and the pin slot 106. The pin slot 106 is provided with a substantially horizontal space permitting a desired horizontal freedom of movement of the securing pin therein. In other words, where the securing pin 104 is held vertically fixed by the attachment to the sidewalls 37 of the door-waiter 34, the horizontal space in the pin slot 106 permits a specified relative movement of the door-waiter 34 relative to the pivot body 86. The springs 102 in the pin slot 106 push perpendicularly on the securing pin 104 to bias the door-waiter 34 into a certain position relative to the pivot body 86 which is essentially axially fixed (although relatively rotatable) to the door bracket 7. This spring bias can be overcome by certain applied forces, as described below, which may force the door-waiter 34 to move relative to the pivot body 86. A pair of set screws 108 may be provided to connect with the springs 102 to compress or extend the springs 26 in order to regulate the spring tension on the securing pin 104.

Figure 12:
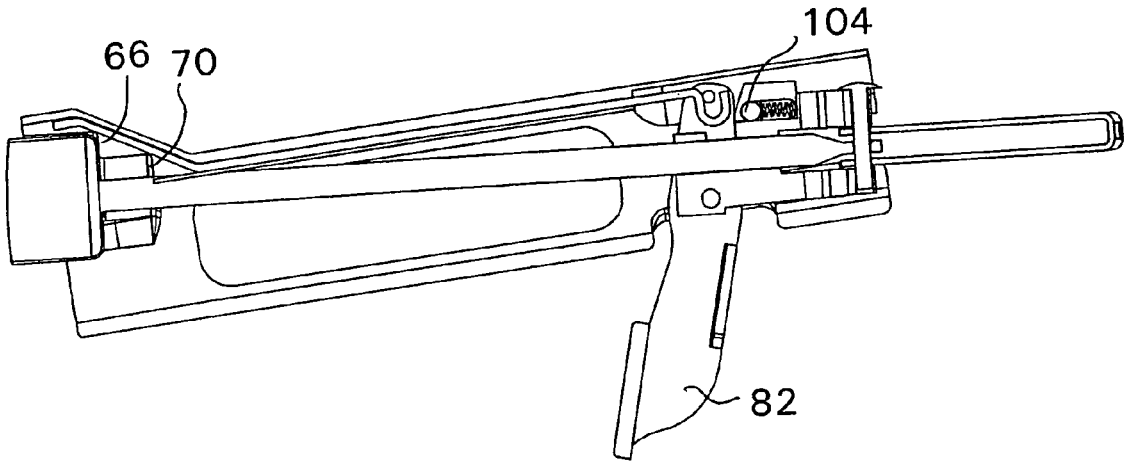
FIG. 12 is a cross-sectional view of the present invention with a kick-out assembly in the locked position.

Turning to FIG. 12, the door 2 is being held in the open and locked position with the door-waiter 34 engaging the first end 15 of the damping cylinder 12 as previously described.

Figure 13:
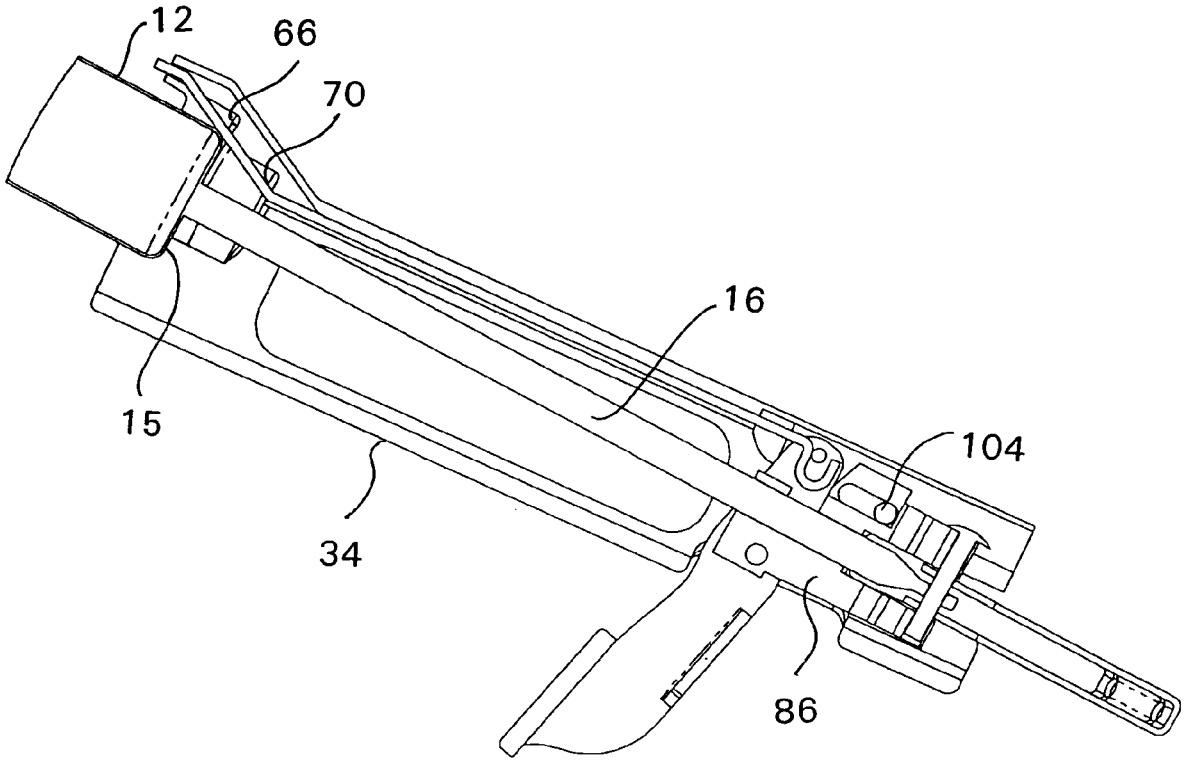
FIG. 13 is a cross-sectional view of the door-waiter unlocked to close the door without actuation of kick-out assembly.

The secondary aspects of the kick-out assembly 80, the automatic release response occurs when an excessive force is used to close the door 2 without physically actuating the release lever 82 of the kick-out assembly 80. Where the door 2 is being held open by the door-waiter 34, as in FIG. 12, and a force is applied to close the door 2 directly without actuation of the release lever 82. In this case, the cylinder 12 presses against the first step 66 of the door-waiter 34 which transmits this force to the securing pin 104 connecting the door-waiter 34 to the pivot body 86. The securing pin 104 presses against the inherent bias of the preloaded springs 102, moving the pin 104 to the far end of the slot as seen in FIG. 13.

In this manner, the door-waiter 34 is permitted to move relative to the pivot body 86 against the bias of the springs 102, the pivot body 86 substantially maintains the push rod 84 in a static position relative to the moving door-waiter 34. As the door-waiter 34 moves axially away from engagement with the damping cylinder 12, the push rod 84, which is remaining somewhat axially immovable, forces the first end 15 of the damping cylinder 12 off the radial first step 66 and guides it down into the door-waiter 34 permitting the door 2 to close.

Since certain changes may be made in the above described improved door closer and door holder, without departing from the spirit and scope of the invention herein involved, it is intended that all of the subject matter of the above description or shown in the accompanying drawings shall be interpreted merely as examples illustrating the inventive concept herein and shall not be construed as limiting the invention.

What is claimed is:

1. A door closer (10) comprising: a frame bracket (7) and a door bracket (4);

a spring-loaded cylinder (12) and piston rod assembly (16) extendable between an open and a closed positions;

a door-waiter (34) pivotably supported adjacent a first end (18) of the piston rod (16) connected to one of the frame bracket and the door bracket;

the door-waiter (34) is capable of retaining the spring-loaded cylinder (12) and piston rod assembly (16) by rotating about its pivotal support adjacent the first end (18) of the piston rod (16) and engaging an at least one radial step (66) formed along an inner wall of the door-waiter (34) with an end surface of the cylinder (12) allowing the door to be held in at least one partially opened position without full extension of the piston rod assembly; and wherein a release lever (82) is pivotably supported at a pivot joint adjacent the first end (18) of the piston rod (16) and a push rod (84) abutting the release lever (82) and positioned substantially axially aligned along the inner sidewall (37) between the door-waiter (34) and the cylinder (12) and the push rod (84) disengages the end surface of the cylinder (12) from the at least one radial step (66).

2. The door closer apparatus of claim 1 wherein the release lever pivots at an intermediate pivot point (88) independent of the door-waiter about a pivot body (86).

3. The door closer apparatus of claim 1 further comprising a push rod pivot (90) attached to the release lever (82) for abutting the release lever (82) against the push rod (84).

4. The door closer apparatus of claim 3, wherein the push rod contains a hook configured to receive the push rod pivot (90).

5. A method of maintaining a door closure in a partially open position comprising the steps of:

mounting a frame bracket on a door frame (7) and a door bracket on a door;

supporting a spring-loaded cylinder (12) and piston rod assembly (16) between the frame bracket and the door bracket;

attaching a cylinder housing (34) at least partially encompassing the cylinder and piston rod assembly and pivotably supporting the cylinder housing adjacent a first end (18) of the piston rod (16); and providing the cylinder housing with a first end pivotably supported adjacent the first end of the piston rod and a second end defining at least one radial step (66) formed on an inner wall of the cylinder housing for abutting an end of the cylinder, holding the door in the partially open position;

pivotably supporting a release lever at a pivot joint relative to the cylinder housing (34); and actuating a push rod (84) abutting the lever and positioned substantially axially aligned between the cylinder housing (34) and the cylinder to disengage the abutting end of the cylinder with any radial step formed in the door-waiter cylinder housing (34) and move the door closure to a closed position.

6. The method of maintaining a door closure in a partially open position as set forth in claim 5 further comprising the step of forming a plurality of axially spaced apart steps (66, 70) for abutting the end of the cylinder.

7. The method of maintaining a door closure in a partially open position as set forth in claim 6 further comprising the step of radially moving the second end of the cylinder housing relative to the cylinder and piston rod assembly to facilitate abutting engagement of the step (66) on the cylinder housing with the cylinder.

* * * * *